US011377254B2

(12) United States Patent
Wang et al.

(10) Patent No.: US 11,377,254 B2
(45) Date of Patent: Jul. 5, 2022

(54) FOLDABLE PACKING BOX WITH FOLDABLE HONEYCOMB STRUCTURE

(71) Applicant: Sunding Electronics Material(DG)Co. Ltd, Dongguan (CN)

(72) Inventors: Tingfu Wang, Dongguan (CN); Qianwen Wang, Dongguan (CN); Bodong Wang, Dongguan (CN)

( * ) Notice: Subject to any disclaimer, the term of this patent is extended or adjusted under 35 U.S.C. 154(b) by 0 days.

(21) Appl. No.: 16/632,380

(22) PCT Filed: Jan. 2, 2018

(86) PCT No.: PCT/CN2018/070067
§ 371 (c)(1),
(2) Date: Jan. 20, 2020

(87) PCT Pub. No.: WO2019/033693
PCT Pub. Date: Feb. 21, 2019

(65) Prior Publication Data

US 2020/0231328 A1 Jul. 23, 2020

(30) Foreign Application Priority Data

Aug. 17, 2017 (CN) ..... 201710708398.8

(51) Int. Cl.
*B65D 5/50* (2006.01)

(52) U.S. Cl.
CPC ..... *B65D 5/5016* (2013.01)

(58) Field of Classification Search
CPC ..... B65D 5/5016; B65D 5/48004; B65D 5/48026; B65D 5/441; B65D 5/5054;
(Continued)

(56) References Cited

U.S. PATENT DOCUMENTS 5,462,171 A * 10/1995 Moog ..... B65D 81/113 206/588
6,712,022 B2 3/2004 Fullerton, III
(Continued)

FOREIGN PATENT DOCUMENTS

CN 2494320 Y 6/2002
CN 203753550 U 8/2014
(Continued)

*Primary Examiner* — Ernesto A Grano

(57) ABSTRACT

The present invention discloses a foldable packing box with a foldable honeycomb structure, which includes a foldable box body with two pairs of opposite side walls, two connecting plates and the foldable honeycomb structure arranged in said foldable box body; the two connecting plates are respectively connected with one pair of opposite said side walls of the box body, the foldable honeycomb structure is arranged between the two connecting plates and connects with them; the foldable honeycomb structure includes multiple pieces of flexible cardboard with adhesive and non-adhesive parts arranged at intervals on each flexible cardboard; the adhesive parts of adjacent two the flexible cardboards are pasted together to form joints, and holes are formed between adjacent the non-adhesive parts; a top of the foldable honeycomb structure is provided with a receiving slot matching articles to be stored. The packing box with foldable honeycomb structure protects the conveying articles and avoids damage.

4 Claims, 2 Drawing Sheets

(58) Field of Classification Search
CPC ..... B65D 5/5057; B65D 5/5085; B65D 2519/00303; B65D 65/44; B65D 81/075; B65D 81/113; B65D 81/054
USPC ..... 206/521
See application file for complete search history.

(56) References Cited

U.S. PATENT DOCUMENTS

| | | | | |
|---|---|---|---|---|
| 7,264,147 | B1 | 9/2007 | Benson | |
| 8,196,806 | B2 | 6/2012 | Tao | |
| 8,944,312 | B2 | 2/2015 | Won et al. | |
| 9,016,554 | B2 | 4/2015 | Lee | |
| 9,884,713 | B2 | 2/2018 | Yen | |
| 2005/0082200 | A1* | 4/2005 | Robinson, Jr. ..... | B65D 81/054 206/586 |

FOREIGN PATENT DOCUMENTS

| | | | | |
|---|---|---|---|---|
| CN | 107352140 | A | | 11/2017 |
| JP | H11268769 | A | | 10/1999 |
| JP | 2002205772 | A | | 7/2002 |
| JP | 2011057229 | A | * | 3/2011 |
| JP | 2011057229 | A | | 3/2011 |
| JP | 2015129007 | A | | 7/2015 |

* cited by examiner

FOLDABLE PACKING BOX WITH FOLDABLE HONEYCOMB STRUCTURE

The present invention involves the technical field of packing box, more particularly, to foldable packing box with foldable honeycomb structure.

BACKGROUND

Common packing box for transporting articles on the market are mostly cuboid or cube. During transporting process, the packing box will inevitably collide, squeeze and bump, resulting in damage to the articles in it. Especially for valuables or easily damaged articles, the loss rate in the transportation process is extremely high, resulting in huge economic losses. For avoiding economic losses, people often place flexible materials such as foam in the packing box to prevent the damage of the articles. However, this greatly increases transport costs, and the heavily use of foam has caused environmental pollution.

SUMMARY

For overcoming the shortcomings of the prior art, the present invention provides foldable packing box with [[one]] foldable honeycomb structure, the foldable honeycomb structure is arranged in the foldable packing box, and a storage tank is dug in it, thus protecting the transporting articles and avoiding damage during transportation process.

The technical schemes of the present invention are as follows: the foldable packing box with foldable honeycomb structure includes a foldable box body with two pairs of opposite side walls, two connecting plates and the foldable honeycomb structure arranged in the foldable box body. The two connecting plates are respectively fixedly connected with the opposite two side walls of the foldable box body, the foldable honeycomb structure is arranged between the two connecting plates and fixedly connected with them. The foldable honeycomb structure includes multiple pieces of flexible cardboard with adhesive and non-adhesive parts arranged at intervals on each flexible cardboard. The adhesive parts of adjacent the flexible cardboard are pasted together to form joints, and the non-adhesive parts of adjacent two the flexible cardboard are not pasted to form holes. A top of the foldable honeycomb structure is provided with a receiving slot matching articles to be stored.

Each of the connecting plates has a first connecting part and a second connecting part, the first connecting part fixedly connects with one of the side walls of the box body; the second connecting part fixedly connects with the foldable honeycomb structure.

The first connecting part and the second connecting part can be pivoted relatively, and when the foldable packing box is folded, the first connecting part and the second connecting part basically remain in the same horizontal plane, and the foldable honeycomb structure is fold; when the foldable packing box is expanded, the second connecting part is pivoted to a position basically perpendicular to the first connecting part, and the foldable honeycomb structure is unfold.

The top of the second connecting part is provided with an arc groove, and the flexible cardboard is an arc; when the foldable honeycomb structure is folded, the multiple pieces of the flexible cardboard are folded together with the connecting plate, and when the foldable honeycomb structure are stretched, a hemispherical groove is formed between the two connecting plates.

Preferably, the box body has a cover, and the cover is provided with a second honeycomb structure.

The second honeycomb structure also includes multiple pieces of second flexible cardboard with second adhesive parts and second non-adhesive parts arranged at intervals on each piece of the second flexible cardboard; the second adhesive parts on the adjacent two second flexible cardboards are pasted together to form second connecting parts, and the second non-adhesive parts on the adjacent two second flexible cardboards are not pasted together to form second holes.

The beneficial effect of the invention are as follows: The foldable packing box with foldable honeycomb structure is provided with a receiving slot, and the receiving slot limits the moving position of the articles in it and has a good cushioning effect, thus protecting the transporting articles and avoiding damage during transporting process.

DETAILED DESCRIPTION OF EMBODIMENTS

For the purpose of the invention, the technical scheme and the technical effect are more clearly understood, and the invention will be further described in the following with reference to specific embodiments. It is to be understood that the specific embodiments described herein are for illustrative purposes only and are not intended to limit the invention.

Figure 1:
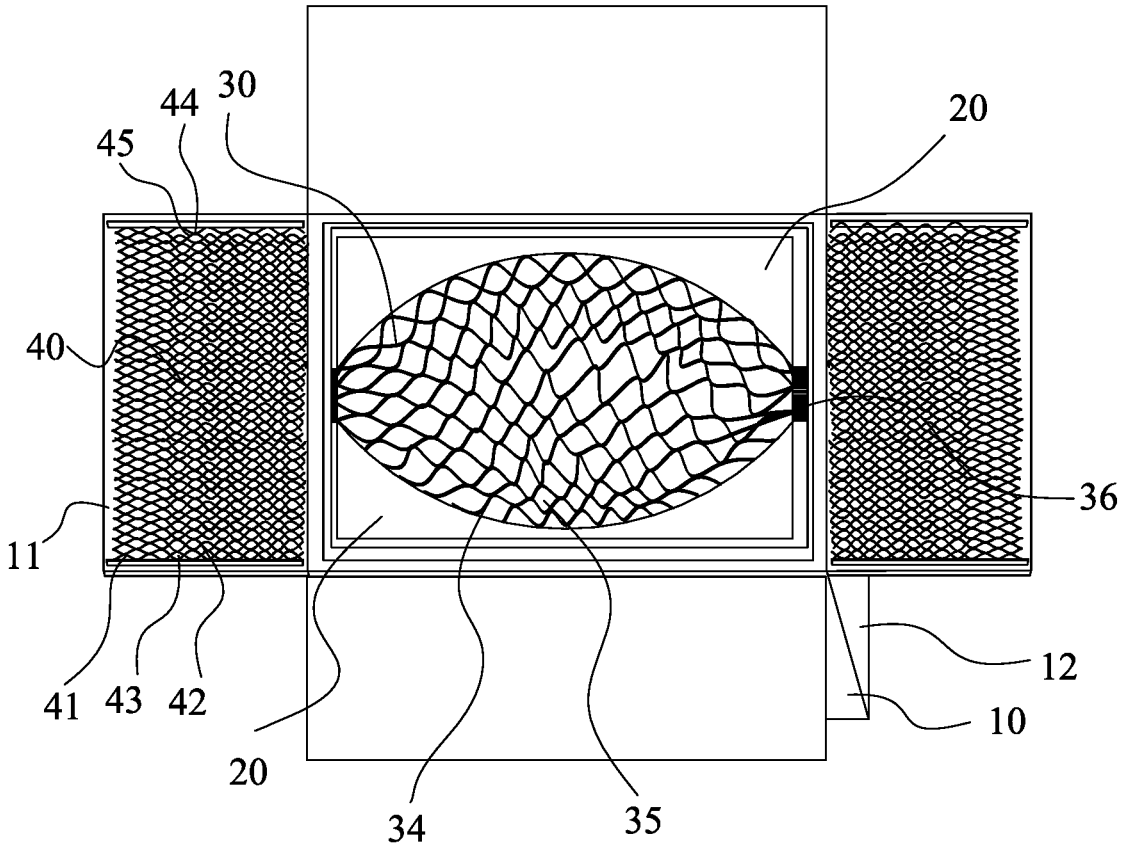
FIG. 1 is a perspective view of the foldable packing box with foldable honeycomb structure in the present invention.

Referring to FIG. 1, the foldable packing box with foldable honeycomb structure, includes a box body 10 with the opposite two side walls 12, two connecting plates 20 and a foldable honeycomb structure 30 arranged in the box body 10. The two connecting plates 20 are respectively fixedly connected with the opposite two side walls of the box body 10. The foldable honeycomb structure 30 is arranged between the two connecting plates 20 and fixedly connected with them.

Figure 2:
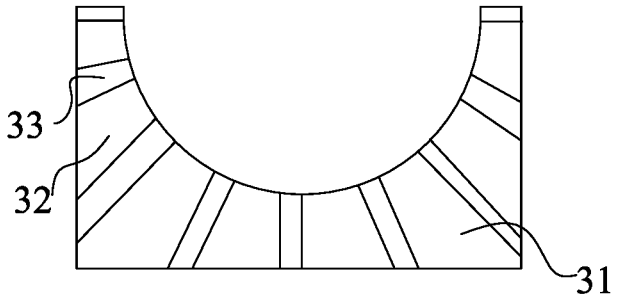
FIG. 2 is a perspective view of the flexible cardboard 31 of the foldable packing box with foldable honeycomb structure in the present invention.

Referring to FIG. 2, the foldable honeycomb structure 30 includes multiple pieces of flexible cardboard 31 with adhesive parts 32 and non-adhesive parts 33 arranged at intervals. The adhesive parts 32 of the adjacent two flexible cardboard 31 are pasted together to form joints 34, and The non-adhesive parts 33 of the adjacent two flexible cardboard 31 are not pasted together to form holes 35.

The top of the foldable honeycomb structure 30 is provided with a receiving slot 36 matching with the articles to be stored. When the articles are accommodated in the receiving slot 36, the foldable honeycomb structure 30 provides a good cushioning effect to prevent damage to the articles when the packing box is collided.

Figure 3:
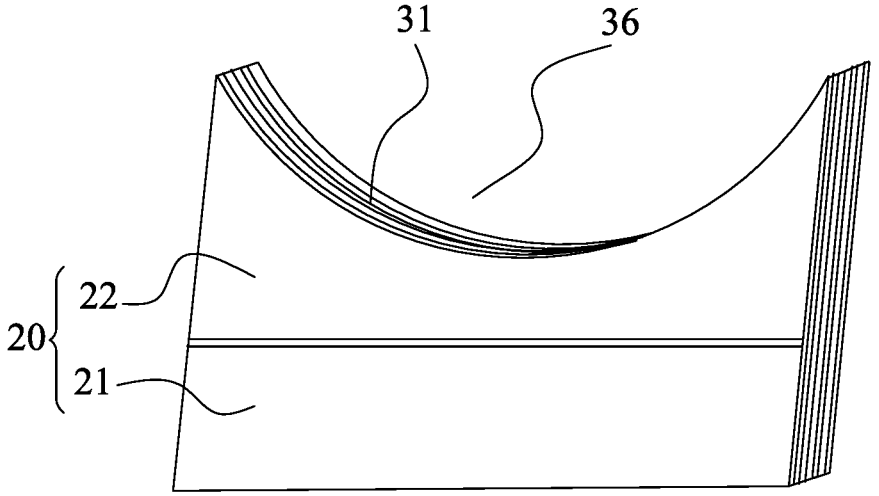
FIG. 3 is a perspective view of the two connecting plates 20 and foldable honeycomb structure 30 in the foldable packing box with foldable honeycomb structure in the present invention. The FIG. 3 shows the state of the connection plate 20 and the foldable honeycomb structure 30.

Referring to FIG. 3, each of the connecting plates 20 has a first connecting part 21 and a second connecting part 22, the first connecting part 21 fixedly connects with one of the side walls of the box body 10; the second connecting part 22 fixedly connects with the foldable honeycomb structure 30.

Figure 4:
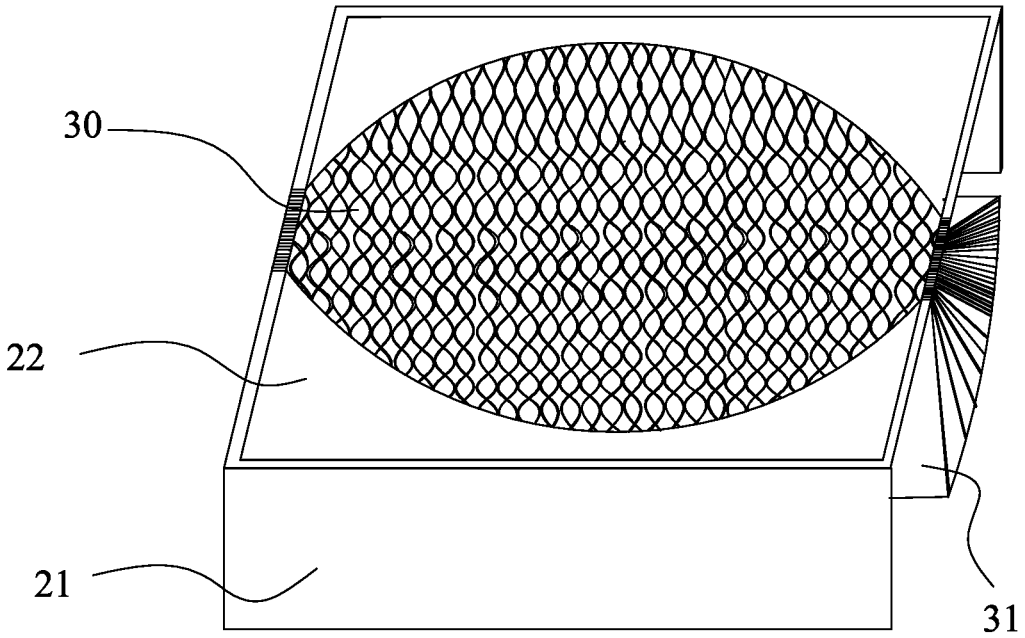
FIG. 4 is a decomposition view of FIG. 3, the figure shows the state of the connection plate 20 and the folded honeycomb 30 unfolded.

Referring to FIG. 3 and FIG. 4, the first connecting part 21 and the second connecting part 22 can be pivoted relatively, and when the packing box 10 is folded, the first connecting part 21 and the second connecting part 22 basically remain in the same horizontal plane, and the foldable honeycomb structure 30 is folded. When the packing box 20 is expanded, the second connecting part 22 is pivoted to a position basically perpendicular to the first connecting part 21, and the foldable honeycomb structure 30 is unfolded.

The foldable packing box of the invention can excellently preserve the article and avoid being damaged during transporting process. To achieve the object, the top of the foldable honeycomb structure is designed as different slots for the different articles.

For example, referring to FIG. 1 and FIG. 3, in one embodiment of the invention, the foldable packaging box is used to hold watermelon or spherical articles. In the embodiments, the top of the second connecting part 22 is designed as an arc slot, and the flexible cardboard 31 is an arc; when the foldable honeycomb structure is folded, the multiple pieces of the flexible cardboard 31 are folded together with the connecting plates 20, and when stretched, a hemispherical slot 36 is formed between the two connecting plates 20. Watermelon or spherical articles can be accommodated in the hemispherical slot 36.

When the foldable packing box is used to store the vase, a cavity matching the shape of the vase is excavated on the top surface of the foldable honeycomb structure 30.

Preferably, referring to FIG. 1, the foldable box body has a cover 11, the cover 11 is provided with a second honeycomb structure 40, and the second honeycomb structure 40 is the same as the folded honeycomb structure 30. The second honeycomb structure 40 also includes multiple pieces of second flexible cardboard 41 with second adhesive parts 44 and second non-adhesive parts 45 arranged at intervals; the second adhesive parts 44 on adjacent two the second flexible cardboards are pasted together to form second connecting parts 42, and the second non-adhesive parts on adjacent two the second flexible cardboards are not pasted together to form second holes 43. The second honeycomb structure 40 protects the top of the articles during transporting process.

The above is a further detailed description of the invention in combination with a specific preferred embodiment, and it can not be concluded that the specific implementation of the invention is limited to these instructions. For the general technical personnel in the technical field to which the invention belongs, without being separated from the conception of the invention, the architecture form can be flexible and changeable, and a series of products can be derived. If it is just making a number of simple deductions or substitutes should be regarded as falling within the scope of patent protection determined by the claim submitted by the present invention.

What is claimed is:

1. A foldable packing box with foldable honeycomb structure, comprising: a foldable box body with two pairs of opposite side walls, wherein also comprising:

two connecting plates and said foldable honeycomb structure arranged in said foldable box body; two said connecting plates are respectively fixedly connected with one pair of opposite said side walls of said foldable box body, said foldable honeycomb structure is arranged between two said connecting plates and fixedly connect with them; said foldable honeycomb structure includes multiple pieces of flexible cardboard with adhesive and non-adhesive parts arranged at intervals; said adhesive parts of adjacent two said flexible cardboard are pasted together to form joints, and said non-adhesive parts of adjacent two said flexible cardboard are not pasted together to form holes; a top of said foldable honeycomb structure is provided with a receiving slot matching with articles to be stored;

each of said connecting plates has a first connecting part and a second connecting part, said first connecting part fixedly connects with said side wall of said foldable box body; said second connecting part fixedly connects with said foldable honeycomb structure;

said first connecting part and said second connecting part can be pivoted relatively, and while said foldable packing box is folded, said first connecting part and said second connecting part remain in the same horizontal plane, and said foldable honeycomb structure is folded; after said packing foldable box is expanded, said second connecting part is pivoted to a position perpendicular to said first connecting part, said foldable honeycomb structure is unfolded.

2. The foldable packing box with foldable honeycomb structure according to claim 1, wherein a top of said second connecting part is provided with an arc slot, and said flexible cardboard is an arc; while said foldable honeycomb structure is folded, multiple pieces of said flexible cardboard are folded together with said connecting plate, and after said foldable honeycomb structure are stretched, a hemispherical slot is formed between two said connecting plates.

3. The foldable packing box with foldable honeycomb structure according to claim 1, wherein said box body has a cover, said cover is provided with a second foldable honeycomb structure.

4. The foldable packing box with foldable honeycomb structure according to claim 3, wherein said second honeycomb structure also includes multiple pieces of second flexible cardboard with second adhesive parts and second non-adhesive parts arranged at intervals; said second adhesive parts of adjacent two said second flexible cardboards are pasted together to form second connecting parts, and said second adhesive parts of adjacent two said second flexible cardboards are not pasted together to form second hole.

* * * * *